US007132125B2

(12) United States Patent
Hammond et al.

(10) Patent No.: US 7,132,125 B2
(45) **Date of Patent: *Nov. 7, 2006**

(54) PROCESSES FOR COATING PHOTOCONDUCTORS

(75) Inventors: John M. Hammond, Livonia, NY (US); Thomas A. Trabold, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 224 days.

This patent is subject to a terminal disclaimer.

(21) Appl. No.: 10/012,439

(22) Filed: Dec. 12, 2001

(65) Prior Publication Data

Related U.S. Application Data

(63) Continuation-in-part of application No. 09/953,526, filed on Sep. 17, 2001, now Pat. No. 6,706,315.

(51) Int. Cl.
*B05D 5/06* (2006.01)

(52) U.S. Cl. ..... 427/162; 427/74; 427/105; 427/144; 427/256; 427/286; 427/402; 427/407.1; 427/419.1; 427/425; 427/240; 118/107; 118/210; 118/320; 399/116; 399/117; 399/159

(58) Field of Classification Search ..... 427/74, 427/105, 144, 256, 286, 402, 407.1, 419.1, 427/425, 240, 346, 162; 118/107, 210, 320, 118/52, 56, 57; 399/116, 117, 159
See application file for complete search history.

(56) References Cited

U.S. PATENT DOCUMENTS 3,849,128 A * 11/1974 Ihara ..... 430/132
4,265,990 A 5/1981 Stolka et al.
4,390,611 A 6/1983 Ishikawa et al.
4,551,404 A 11/1985 Hiro et al.
4,588,667 A * 5/1986 Jones et al. ..... 430/73
4,596,754 A 6/1986 Tsutsui et al.
4,797,337 A 1/1989 Law et al.
4,988,597 A 1/1991 Spiewak et al.
5,112,656 A * 5/1992 Nakamura et al. ..... 430/133
5,202,214 A * 4/1993 Kawamorita et al. ..... 430/133
5,244,762 A 9/1993 Spiewak et al.
5,677,094 A * 10/1997 Umeda et al. ..... 430/58.05
5,725,985 A * 3/1998 Nealey et al. ..... 430/58.05
5,871,832 A * 2/1999 Finn et al. ..... 428/98
6,048,658 A * 4/2000 Evans et al. ..... 430/132

(Continued)

FOREIGN PATENT DOCUMENTS

JP 63-172159 A * 7/1988

(Continued)

OTHER PUBLICATIONS

Trabold, et al, Coating Die with Laser Position Sensors, U.S. Appl. No. 09/953,526, filed Sep. 17, 2001.

*Primary Examiner*—Alain L. Bashore
(74) *Attorney, Agent, or Firm*—Eugene O. Palazzo; Fay, Sharpe, Fagan, Minnich & McKee, LLP

(57) ABSTRACT

A process including: providing a cylindrical substrate rotating about the long axis; applying at least one coating layer with a direct writing applicator on the outer surface of the rotating substrate; and curing the resulting coated layer or layers. The use of a direct writing applicator provides precision in the dispensing of organic photoconductor coating layers with respect to line width and line thickness.

14 Claims, 2 Drawing Sheets

U.S. PATENT DOCUMENTS 6,180,325 B1 * 1/2001 Gelbart ..... 430/397
6,214,513 B1 4/2001 Cai et al.
6,245,475 B1 * 6/2001 Scharfe et al. ..... 430/127
6,706,315 B1 * 3/2004 Trabold et al. ..... 427/8
2003/0054107 A1 * 3/2003 Trabold et al. ..... 427/355
2003/0157243 A1 * 8/2003 Trabold et al. ..... 427/8

FOREIGN PATENT DOCUMENTS

JP 63-172160 A * 7/1988
JP 02-272561 A * 11/1990
JP 07-178367 A * 7/1995

* cited by examiner

PROCESSES FOR COATING PHOTOCONDUCTORS

CROSS REFERENCE TO COPENDING APPLICATIONS AND RELATED PATENTS

This application is a continuation-in-part of and claims priority under 35 U.S.C. § 120 to U.S. application Ser. No. 09/953,526, now U.S. patent No. 6,706,315, filed on Sep. 17, 2001.

Attention is directed to commonly assigned copending applications: U.S. Pat. No. 6,214,513 discloses a coating process for the fabrication of organic photoreceptors which process employs an electrically conductive single slot die biased to allow an electric field between the die and the ground plane on the photoreceptor substrate. The homogenous coating dispersion is fed through the die at a predetermined gap and rate to control coating thickness at the same time that an electric field is applied. The formulation, rheology, particle mobility, coating speed, electric field and the like are controlled so that the photogenerator particles migrate to the substrate in the dwell time defined by the coating die region.

U.S. Ser. No. 09/716,412, filed Nov. 21, 2000, discloses a coating apparatus which includes a coating device that dispenses coating material, a rotation device that rotates an object to be coated, and a movement device that effects relative movement of the coating device and the rotation device in a direction parallel to a rotation axis of the rotation device. The coating device in a specific embodiment includes a slot, extending substantially parallel to the rotation axis of the rotation device, through which the coating material is dispensed. A relationship of (a) a ratio R of an angular speed of rotation of the rotation device to a speed of the relative movement and (b) a length L of the slot is $R=2\pi/L$.

U.S. Ser. No. 10/369810 filed Feb. 19, 2003, discloses a laser guided die coater device and coating apparatus.

The disclosures of each the above mentioned patent and copending applications are incorporated herein by reference in their entirety. The appropriate components and processes of these patents may be selected for the processes of the present invention in embodiments thereof.

BACKGROUND OF THE INVENTION

The present invention is generally directed to processes for treating, such as by coating substrates, and more specifically, to processes for coating cylindrical substrates which processes provide precise coating layer thicknesses and widths. The resulting precision coated substrates provide articles or devices that are useful in, for example, printing systems and printing processes such as organic film coated drum photoconductors, thermal fusing rolls, and the like articles.

The coating processes of the present invention can be adapted to provide value-added and enhanced performance capabilities to known printing and copying devices, such as printers, copiers, facsimile, and related multifunction printing devices.

DESCRIPTION OF RELATED ART

In a typical electrostatographic printing system, a light image or digital image of an original to be reproduced is recorded in the form of an electrostatic latent image upon a photosensitive member such as an organic photoconductor and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused, for example with a thermal or radiant fuser roll, upon a support which may be the photosensitive member itself or another support sheet such as plain paper. Other related marking technologies are known, for example, liquid immersion development, and solid or liquid ink jet imaging technologies wherein a liquid, solid, molten, sublimed, and the like marking formulations are deposited onto an imaging member, imaging intermediate member, or image receiver. In the dip coating process, a cylindrical drum is dipped into a tank of coating material and then withdrawn, with a portion of the coating material adhering to the drum. The adhered coating material is then allowed to cure.

However, there are disadvantages inherent in the dip coating process. For example, there can be large variations in coating thickness along the length of a vertically positioned drum photoreceptor, with a relatively thin layer produced at the top and a relatively thick layer produced at the bottom. This gravitational effect is particularly evident for viscous coating materials. Also, it is easy for impurities to enter the coating material because the coating solution is constantly recirculated and in contact with residues or the like from the drums. There is a spatial vortex which forms around the drum during the coating process which traps these impurities and deposits them onto the coated film. Additionally, the coating material is restricted to materials that have a relatively long "pot life" , i.e., materials that can stay in a dip coating tank for a relatively long time without hardening or otherwise becoming unusable. Another disadvantage is the relatively large amount of time required for the dip coating process, especially since the undercoated layer, charge generation layer and charge transport layer must each be formed in a separate dip coating step, with curing time required in between each dip coating step.

Additionally, in dip coating, the substrate must be introduced and withdrawn slowly in order to provide the uniform liquid layer, which adds to the time required for coating. In the case of large drums, which can be quite heavy, it is difficult to precisely position the drum during the dip coating operation.

In the slot die coating process, coating material is caused to flow through a slot while a photoreceptor belt of a width approximately equal to the length of the slot is fed past the slot in a direction transverse to the length of the slot.

This invention provides coating methods and apparatuses that overcome the disadvantages of dip coating and employ some of the advantages of slot die coating.

In embodiments, the present invention can be readily adaptable to the manufacture of precision coated articles, such as, photoreceptor rolls and drums, fuser rolls, backer rolls, cleaning rolls, specialty coated papers or transparency stock, photoreceptor web stock, coated paper web stock, and the like articles or materials.

In embodiments, the coating processes of the present invention provide valuable benefits and excellent satisfaction levels in the manufacturer of coated articles, apparatus, devices incorporating the coated articles, for example, in providing coater articles with uniform coating thicknesses and homogenous coating layers, in avoiding material waste, reducing manufacturing cycle times and costs, and in downtime and productivity losses associated with less efficient coating methods and apparatuses. These and other advantages of the present invention are achievable.

There remains a need for lowering finishing costs, dispensing fabrication materials with a wide range of rheological and electrical properties. There is also a need for high precision direct writing apparatus to fabricate single and multi-layer drum photoconductors with precise layer thickness uniformity.

SUMMARY OF THE INVENTION

This invention and embodiments provide coating methods and apparatuses that overcome or minimize the disadvantages of dip coating and employ some of the advantages of slot die coating.

This invention provides methods and apparatuses for coating objects without requiring dip coating. The methods and apparatuses offer uniform, fast coating by dispensing coating material onto a rotated object in a helical pattern. In one aspect of the invention, i.e., the coating apparatus includes a coating device that dispenses coating material, a rotation device that rotates an object to be coated, and a movement device that relatively moves the coating device with respect to the rotation device in a direction parallel to a rotation axis of the rotation device. The coating device preferably includes a slot, extending substantially parallel to the rotation axis of the rotation device through which the coating material is dispensed. A relationship of (a) a ratio R of an angular speed of rotation of the rotation device to a speed of the relative movement and (b) a length L of the slot is about $R=2\pi/L$ This invention and embodiments provide methods and apparatuses for coating objects without dip coating. The methods and apparatuses offer uniform, fast coating by dispensing coating material onto a rotated object in a helical pattern. In one aspect of the invention, a coating apparatus includes a coating device that dispenses coating material, a rotation device that rotates an object to be coated, and a movement device that relatively moves the coating device with respect to the rotation device in a direction parallel to a rotation axis of the rotation device. The coating device in a specific embodiment includes a slot, extending substantially parallel to the rotation axis of the rotation device, through which the coating material is dispensed. Aspects of the present invention include the following:

A process comprising:

providing a cylindrical substrate rotating about the long axis;

applying at least one coating layer with a direct writing applicator on the outer surface of the rotating substrate; and curing the resulting coated layer or layers These and other embodiments of the present invention are illustrated herein.

DETAILED DESCRIPTION OF THE INVENTION

In embodiments of the present invention there is provided a process comprising:

providing a cylindrical substrate rotating about the long axis;

applying at least one coating layer with a direct writing applicator on the outer surface of the rotating substrate; and curing the resulting coated layer or layers.

Figure 1:
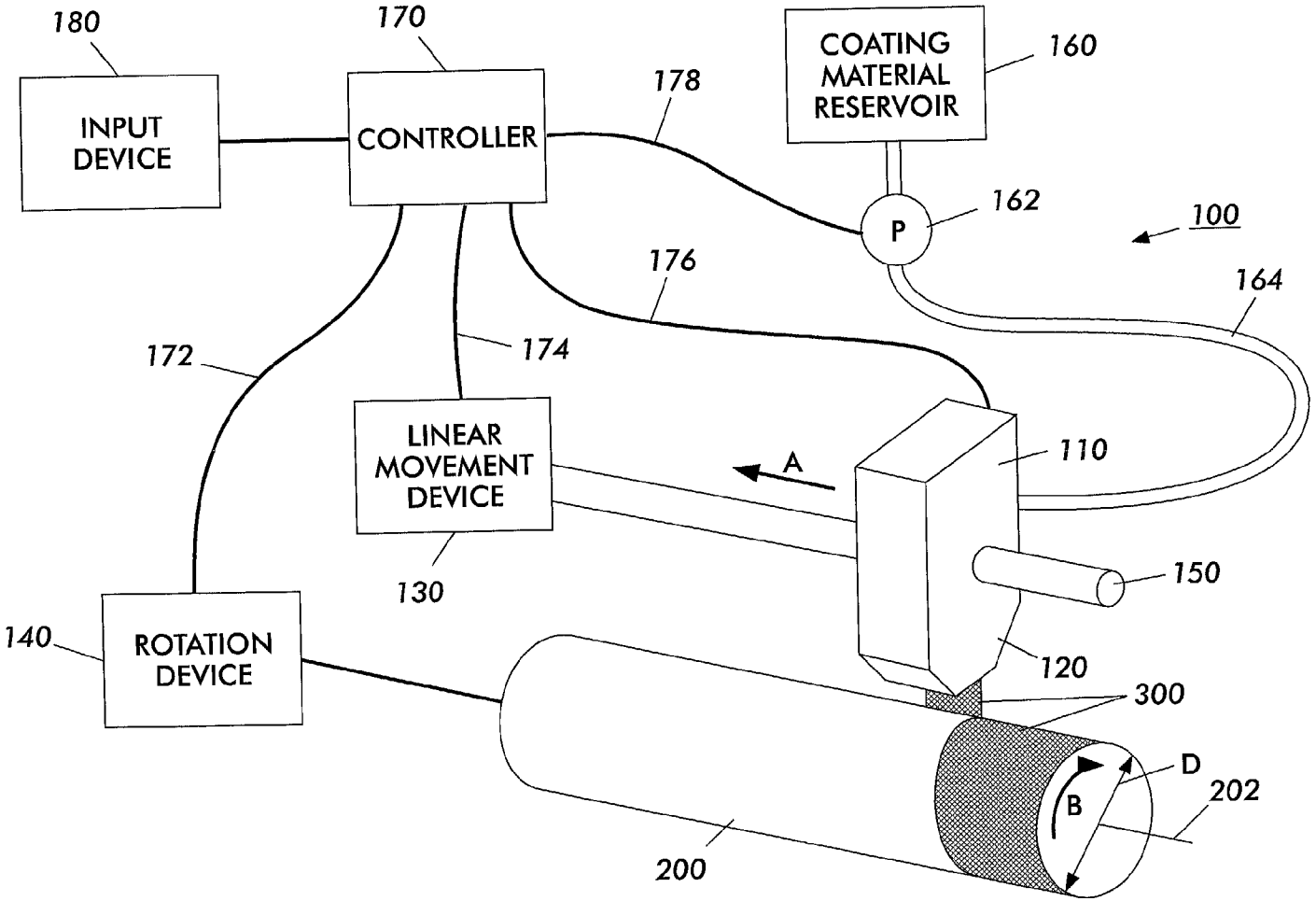
FIG. 1 shows an exemplary coating system which can be in embodiments be adapted for use in the present invention.

This invention provides methods and apparatuses for coating objects without requiring dip coating. The methods and apparatuses offer uniform, fast coating by dispensing coating material onto a rotated object in a helical pattern. FIG. 1 shows an exemplary coating apparatus 100 according to this invention.

The coating apparatus 100 includes a coating device 110, a linear movement device 130 and a rotation device 140. The coating device 110 is in operative connection with a guide/driving device 150, which in turn is in operative connection with the linear movement device 130. For example, the guide/driving device 150 may include a rotating threaded member which is rotated by the linear movement device 130 and drives the coating device 110 back and forth. In this case, additional guides (not shown) may be used as necessary. Any other known or later-developed type of driving/guiding structure that drives the coating device 110 back and forth is also acceptable.

The rotation device 140 rotates a cylindrical object 200 that is to be coated. In FIG. 1, the rotation device 140 rotates the object 200 about a rotation axis 202, also referred to in this specification as a long axis, in the direction shown by arrow B. The rotation device 140 may, for example, have a structure similar to that of a lathe or the like. Additionally, the linear movement device 130 may be mechanically engaged with the rotation device 140, similar to the structure in a conventional metal lathe that turns a workpiece while feeding a cutting tool parallel to the axis of rotation. However, it should be appreciated that any device that effects rotary movement may be used as the rotation device 140, that any device that effects linear movement may be used as the linear movement device 130, and that the rotation device 140 and the linear movement device 130 do not necessarily have to be mechanically engaged, provided that their operations are properly coordinated with each other.

A slot die 120 is attached to the coating device 110. The coating device 110 is connected to a coating material reservoir 160 by a connection passage 164. A pump 162, also designated P, pumps coating material 300 from the coating material reservoir 160. The pump 162 preferably is a variable speed pump so that the flow rate may be adjusted. The coating material 300 flows through the connection passage 164, the coating device 110 and the slot die 120 and is dispensed onto the object 200 while the rotation device 140 rotates the object 200 and the linear movement device 130 moves the coating device 110 in the direction shown by arrow A. The slot die 120 is preferably removably attached to the coating device 110 so that it can be removed and replaced with other slot dies 120, such as, for example, new slot dies or slot dies with different slot sizes.

A controller 170 is connected to the rotation device 140 by a link 172, to the linear movement device 130 by a link 174, and may also be connected to the coating device 110 by a link 176 and/or to the pump 162 by a link 178. The controller 170 controls driving of the object 200 by the rotation device 140, and also controls movement of the coating device 110 by the linear movement device 130. Various control data may be input to the controller 170 via an input device 180, and any control programs and necessary data used by the controller 170 may be stored in a memory (not shown). A message output device such as a monitor or the like (not shown) may also be linked to the controller to prompt and confirm user input, and to output any relevant messages before, during or after processing (e.g., "coating now in progress", etc.). Also, the controller 170 may detect various conditions, such as "coating material reservoir nearly empty" and/or the like, and appropriately inform the operator via the message output device.

The controller 170 may be implemented on a programmed general purpose computer. However, the controller 170 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. The memory (not shown) can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory or the like. Similarly, the non-alterable or fixed memory can be implemented using any one or more of ROM, PROM, EPROM, BEPROM, an optical ROM disk, such as a CD-ROM or DVD-ROM disk, and disk drive or the like.

Figure 2:
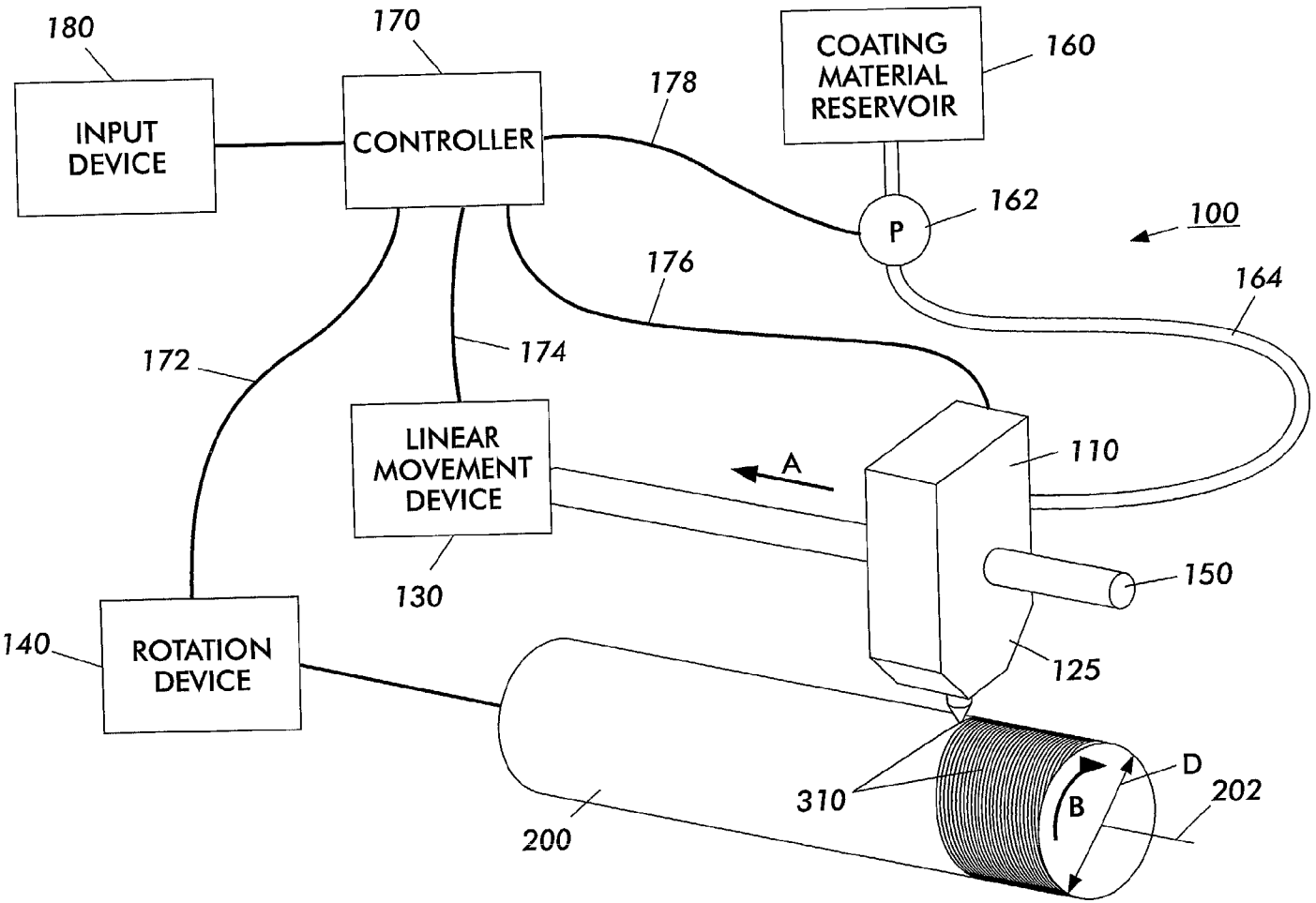
FIG. 2 shows an embodiment of a direct writing applicator device 125. The direct writing applicator device is attached to the coating device 110. The direct writing applicator device dispenses the coating material 310 onto the object 200 while the rotation device 140 rotates the object 200 and the linear movement device 130 moves the coating device 110 in the direction shown by the arrow A.

FIG. 2 shows an embodiment of a direct writing applicator device 125. The direct writing applicator device is attached to the coating device 110. The direct writing applicator device dispenses the coating material 310 onto the object 200 while the rotation device 140 rotates the object 200 and the linear movement device 130 moves the coating device 110 in the direction shown by the arrow A.

It can be seen that the diameter D of the object 200 does not affect the ratio R. However, the diameter D does influence the flow rate requirements of the coating material 300. For example, at a given rotary speed ω, an object 200 with a large diameter D will have a larger peripheral velocity than an object 200 with a smaller diameter D. Likewise, at a given diameter D, a faster rotary speed ω will result in a larger peripheral velocity than a slower rotary speed ω. Therefore, to obtain a desired coating thickness, it is necessary to adjust the flow rate of the coating material 300 depending on the rotary speed ω and/or the diameter D. Therefore, the pump 162 is, in various exemplary embodiments, a variable flow rate pump. Although the flow rate can also be adjusted, for example, by varying the slot width, the flow rate of the pump 162 may be independently controlled, or may be automatically controlled by the controller 170 via the link 178.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized Mylar®. Each coating mixture may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the entire disclosures of these patents being incorporated herein by reference.

In embodiments, a coating mixture may include the materials for a charge barrier layer including, for example, polymers such as polyvinylbutyral, epoxy resins, polyesters, polysiloxanes, polyamides, polyurethanes, and the like. Materials for the charge barrier layer are disclosed in U.S. Pat. Nos. 5,244,762 and 4,988,597, the disclosures of which are totally incorporated herein by reference.

In other embodiments, a coating mixture may be formed by dispersing any suitable charge generating particles in a solution of a film forming polymer. Typical charge generating particles include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; azulene compounds; and the like. Typical film forming polymers include, for example, polyester, polystyrene, polyvinylbutyral, polyvinyl pyrrolidone, methyl cellulose, polyacrylates, cellulose esters, vinyl resins and the like. Preferably, the average particle size of the pigment particles is between about 0.05 micrometer and about 0.10 micrometer. Generally, charge generating layer dispersions for immersion coating mixtures contain pigment and film forming polymer in the weight ratio of from 20 percent pigment/80 percent polymer to 80 percent pigment/20 percent polymer. The pigment and polymer combination are dispersed in solvent to obtain a solids content of between 3 and 6 weight percent based on total weight of the mixture However, percentages outside of these ranges may be employed so long as the objectives of the process of this invention are satisfied. A representative charge generating layer coating dispersion comprises, for example, about 2 percent by weight hydroxy gallium phthalocyanine; about 1 percent by weight of terpolymer of vinyl acetate, vinyl chloride, and maleic acid (or a terpolymer of vinylacetate, vinylalcohol and hydroxyethylacrylate); and about 97 percent by weight cyclohexanone.

Typical charge transport materials include, for example, compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds. Typical film forming polymers include, for example, resins such as polycarbonate, polymethacrylates, polyarylate, polystyrene, polyester, polysulfone, styrene-acrylonitrile copolymer, styrene-methyl methacrylate copolymer, and the like. An illustrative charge transport layer coating composition contains, for example, about 10 percent by weight N,N'-diphenyl-N,N'-bis(3-methylphenyl)-[1,1'-biphenyl]-4,4'diamine; about 14 percent by weight poly(4,4'-diphenyl-1,1'-cyclohexane carbonate (400 molecular weight); about 57 percent by weight tetrahydrofuran; and about 19 percent by weight monochlorobenzene.

In one embodiment, if an operator wants to maintain a given coverage regardless of the coating speed, the operator can instruct the controller 170 to maintain a constant coverage by, for example, inputting the diameter D of the object 200 and the desired coating thickness. The controller 170 then controls the flow rate of the pump 162 and/or other parameters in order to maintain the desired coverage. For example, the controller may control the temperature of the coating material 300 by controlling a heater (not shown) provided on the coating device 110 and/or in the coating material reservoir 160. Additionally, if the coating device 110 is provided with a slot die 120 that has a variable width slot (not shown), and with a suitable slot width adjusting mechanism (not shown), the controller 170 may control the width (not shown) of the slot via the link 176. However, it is generally easier to provide fixed-width slot dies 120 and to controllably vary other parameters.

The controller 170 controls the rotary speed ω and the linear speed V for a given slot length L. For example, an operator may input the slot length L (or this information may be detected automatically), if an appropriate detection device is provided on the coating device 110 and a desired linear speed V into the controller 170 via the input device 180. The operator may also input the object diameter D as described above. The controller 170 then determines the necessary rotary speed ω to correspond to the given specified slot length L and the requested linear speed V. The controller may also determine the appropriate flow rate of the pump 162 based on the rotary speed, object diameter D and/or other parameters as appropriate. Other parameters may include the type of coating material, the material properties of the coating material, such as viscosity, surface tension, or the like, the temperature of coating material, the width of the slot (not shown), and/or the like.

Some actual examples of values of the linear speed V, the rotary speed ω, the 15 linear speed V and the ratio R are given in Table 1.

In an embodiment, a slot die 120 having a slot 122 with a slot length L of about 0.5 inch, or about 12.7 mm, was used.

TABLE 1

| Run No. | Rotary Speed (Revolution/Minute) | Rotary Speed ω (Radians/Minute) | Slot Die Translation Speed V (mm/Minute) | R~ |
|---|---|---|---|---|
| 1 | 10 | 62.8 | 127 | 0.49 |
| 2 | 20 | *125.7* | *254* | 0.49 |
| 3 | 30 | 188.5 | 381 | 0.49 |

TABLE 1-continued

| Run No. | Rotary Speed (Revolution/Minute) | Rotary Speed ω (Radians/Minute) | Slot Die Translation Speed V (mm/Minute) | R~ |
|---|---|---|---|---|
| 4 | 40 | *251.3* | 508 | 0.49 |
| 5 | 50 | 314.2 | 635 | 0.49 |

The above-described coating apparatus has been successfully used to coat a 30 mm diameter drum with a charge generation layer (CGL) solution having the following composition:

Pigment: Metal Free Phthalocyanate (x-$H_2$Pc); 75 weight %

Binder: Polyvinylbutyral BMS; 25 weight %

Solvent: Cyclohexanone (CXN) and n-butyl acetate (BuOAc); 4:1 volume ratio

Total solids weight percentage: 3.6%

In an actual example of the coating apparatus 100, a variable speed pump manufactured by Parker Hannifin Corporation, of Sanford, N.C., was used as the pump 162, a 1/16 inch diameter Teflon tube was used for the passage 164, and the rotation device 140 and the linear movement device 130 were implemented by an Emco PC-SO lathe, manufactured by Emco, of Columbus, Ohio. The best overall coating quality was obtained at the highest coating speed (Run 5 in Table 1).

Before and/or after coating the charge generation layer, other layers can be coated onto the object 200 using the coating apparatus 100, or additional layers may be applied by dip coating. For example, an undercoat layer (UCL) may first be applied by dip coating, then the charge generation layer applied by the coating apparatus 100. Subsequently, a charge transport layer (CTL) may be applied by a dip coating process. This approach was used to fabricate a full photoreceptor device using the above-mentioned CGL solution. The device was electrically tested under standard drum photoreceptor conditions. In another embodiment, each of the undercoat layer, charge generation layer and charge transport layer may be applied using the coating apparatus 100.

Accordingly, the exemplary embodiments of the invention as set forth above are considered to be illustrative and not limiting. Various changes to the described embodiments may be made without departing from the spirit and scope of the invention.

For example, while the object 200 has been described as a cylindrical drum, it could also be in the form of a continuous belt. In this case, the object may be held in a cylindrical shape, e.g., fitted over a cylindrical drum, or may be stretched between two rollers, for example.

The provision of a rotating cylindrical substrate can be accomplished by mounting the substrate on, for example, a rotating spindle or similar structures. The at least one coating layer material can be, for example, a photoconductive material. Alternatively or additionally, the at least one coating can be an electrically insulating material, such as, a polymer or mixture of polymers with little or no electrical conductivity. The process of the present invention can further contain, in embodiments, applying at least one coating of a photoconductive material over the resulting or previously deposited electrically insulating material layer. In embodiments, from about 2 to 10 successive coating layers of a photoconductive material can be applied over the resulting electrically insulating material layer. In embodiments processes of the present invention can further comprise applying at least one coating of a hole transport material over the resulting or previously deposited photoconductive material layer or layers. Still in other embodiments, processes of the present invention can further comprise applying at least one coating of a protective overcoating material over the resulting or previously deposited photoconductive material layer or layers, or hole transport material layer or layers.

In embodiments of processes of the present invention at least one coating can be applied to the substrate by the direct write applicator, for example, in a thickness of from about 0.0001 inches to about 0.01 inches. In embodiments of processes of the present invention the at least one coating can be applied to the substrate by the direct write applicator, for example, in a lateral width of from about 0.002 inches to about 0.2 inches. The rotational rate of the rotating cylinder and the coating dispense rate from the direct write applicator can provide a single coating coverage rate and can be, for example, of from about 0.1 square inches per second to about 5 square inches per second. The coating dispense rate from the direct write applicator can be, in embodiments, continuous and provides a continuous coating layer of uniform layer thickness on the object for coating. Alternatively in embodiments the coating dispense rate from the direct write applicator can be discontinuous and provides a discontinuous coating of uniform layer thickness. The discontinuous coating dispense rate from the direct write applicator can be used to form specialty coated patterns on objects, for example, regions of the coated object, such as a photoreceptor, which have special properties, performance features, or appearances characteristics. In embodiments, the at least one coating can be, for example, a mixture of at least two co-reactive materials, such as different polymerizable monomer components, monomer and catalyst mixture or other co-reactant such as a free radical initiator compound and which coreactive materials can include other known curable materials.

In embodiments the present invention provides a process comprising:

a rotation device that rotates an object to be coated;

a direct writing applicator device that dispenses coating material onto the rotated object to be coated; and a movement device that moves the direct writing applicator device relatively to the object in a direction parallel to a rotational axis of the object.

The direct writing applicator device can be, for example, a "Micropen" which is self-contained, completely integrated synchronous positive displacement pump or pumping system for producing precision deposited images of any fluid material or fluidizable material. Micropens are available commercially from MicroPen Incorporated, a subsidiary of OhmCraft Incorporated, of Honeoye Falls, N.Y. Reference also for example, www.ohmcraft.com for additional description and of the apparatus and other applications and capabilities. A further description of a direct writing applicator may be found in U.S. Pat. No. 4,485,387 to Drumheller, the disclosure of which is incorporated herein by reference. Direct writing technology has been used in other areas to fabricate high precision printed circuit boards and other microelectronic devices comprising resistors, capacitors, interconnecting conductors, and the like devices. The feature sizes of such devices are very precise with respect to line width and line thickness. The direct writing apparatuses that are used to fabricate such devices are essentially high precision dispensing instruments that are capable of dispensing a wide range of liquids and pastes to form the above mentioned microelectronic devices.

The present invention contemplates a number of variations and permutations of the basic coating concept using a die coater with one or more position sensors as disclosed and illustrated herein, for example as follows:

depositing or writing a single layer organic photoconductor material or the like materials in a single step and on a single drum or substrate and which substrate is supported on a rotating shaft;

depositing a single layer organic photoconductor material or the like materials in a single step and on multiple drums or substrates and which substrates are supported end-to-end on a rotating shaft, for example as in a batch coating operation;

depositing a single layer organic photoconductor material or the like materials in a single step and on multiple drums or substrates and which substrates are supported end-to-end on a rotating shaft, and continuously conveyed past a direct write applicator, for example as in a continuous coating operation;

sequentially depositing multiple layers of organic photoconductor material or the like materials on a single drum or substrate and which substrate is supported on a rotating shaft;

sequentially depositing multiple layers of organic photoconductor material or the like materials on multiple drums or substrates and which substrates are supported end-to-end on a rotating shaft; and sequentially depositing multiple layers of organic photoconductor material or the like materials on multiple drums or substrates and which substrates are supported end-to-end on a rotating shaft and continuously conveyed past a direct write applicator, for example as in a continuous coating operation.

In embodiments of the present invention the direct writing applicator device can deposit a spiral trace or pattern of coating material about, that is upon and around, the outer surface of the rotated object. The deposited coating material can in a specific embodiment subsequently flow, spread, or coalesce, for example, by way of various active forces including capillary action, surface centrifugation, surface tension, vibration, ultrasonic excitation, and the like forces, and combinations thereof to produce a smooth, homogenous coating layer of thin film coat on the object of the desired thickness. The direct writing applicator device can be positioned in embodiments from about 1.0 millimeters to about 5 millimeters from the object to be coated. The object or objects for coating can be, for example, a drum, a belt, a drelt, a solid core roller, or a hollow core roller, and the like objects. The rotation device can in embodiments simultaneously rotate from 2 to about 100 objects to be coated. The rotation device can simultaneously rotate and convey the article for coating past one or more direct writing applicators.

The direct writing applicator device can be configured to coat one or more, or a plurality of objects, for example, one or more drums on a single rotating shaft, or a plurality of objects rotated on a plurality of rotating shafts and which shafts are connected to one or more rotation devices. The rotation device can be a motor or equivalents devices and which device is capable of controllably driving the rotation of, for example, a shaft, a mandrel, and the like member, and which members are capable of adapting an object for coating for rotation with the rotation device.

In an embodiment, the apparatus of the present invention can be configured to provide a batch process and apparatus wherein the object or objects for coating can be loaded onto one or more support members, simultaneously rotated relative to one or more direct writing devices, and unloaded from the rotation device or devices to complete the batch operation.

In an alternative embodiment, the apparatus of the present invention can be configured to provide a continuous coating process and apparatus wherein the objects for coating can be continuously loaded, continuously rotated, continuously conveyed past the direct writing applicator for precision coating, and continuously unloaded from the rotation device in assembly-line fashion.

In embodiments, the apparatus of the present invention can be configured to coat multiple layers at a single coating station, that is, a single direct writing applicator or head. Other processing or conditioning accessories can be included within or adjacent to the single coating station, for example, dryer or dryers, or other curing means, such as an ultraviolet light source or other source of heat or radiation, such as a laser beam.

Referring to the Figures, FIG. 1 shows an exemplary coating apparatus 100 disclosed in the abovementioned copending application U.S. Ser. No. 09/712,412, filed Nov. 21, 2000, the disclosure of which can, in embodiments be adapted for use in the present invention, for example, the mechanical hardware and system controls components. The coating apparatus 100 includes a coating device 110, a linear movement device 130 and a rotation device 140. The coating device 110 is in operative connection with a guide drive device 150, such as a screw drive, which in turn is in operative connection with the linear movement device 130. For example, the guide drive device 150 may include a rotating threaded member which is rotated by the linear movement device 130 and drives the coating device 110 back and forth. In this case, additional guides (not shown) can be used as necessary. Any other known or later-developed type of driving or guiding structure that drives the coating device 110 back and forth is also acceptable.

The rotation device 140 rotates a cylindrical object 200 that is to be coated. In FIG. 1, the rotation device 140 rotates the object 200 about a rotation axis 202 in the direction shown by arrow B. The rotation device 140 may, for example, have a structure similar to that of a lathe or the like. Additionally, the linear movement device 130 may be mechanically engaged with the rotation device 140, similar to the structure in a conventional metal lathe that turns a workpiece while feeding a cutting tool parallel to the axis of rotation. However, it should be appreciated that any device that effects rotary movement may be used as the rotation device 140, that any device that effects linear movement may be used as the linear movement device 130, and that the rotation device 140 and the linear movement device 130 do not necessarily have to be mechanically engaged, provided that their operations are properly coordinated with each other.

A slot die 120 is attached to the coating device 110. The coating device 110 is connected to a coating material reservoir 160 by a connection passage 164. A pump 162 pumps coating material 300 from the coating material reservoir 160. The pump 162 in a specific embodiment is a variable speed pump so that the flow rate may be adjusted. The coating material 300 flows through the connection passage 164, the coating device 110 and the slot die 120 and is dispensed onto the object 200 while the rotation device 140 rotates the object 200 and the linear movement device 130 moves the coating device 110 in the direction shown by arrow A. The slot die 120 is in a specific embodiment removably attached to the coating device 110 so that it can be removed and replaced with other slot dies 120, such as, for example, new slot dies or slot dies with different slot sizes.

A controller 170 is connected to the rotation device 140 by a link 172, to the linear movement device 130 by a link 174, and may also be connected to the coating device 110 by a link 176 and, or alternatively, to the pump 162 by a link 178. The controller 170 controls driving of the object 200 by the rotation device 140, and also controls movement of the coating device 110 by the linear movement device 130. Various control data may be input to the controller 170 via an input device 180, and any control programs and necessary data used by the controller 170 may be stored in a memory (not shown). A message output device such as a monitor or the like (not shown) may also be linked to the controller to prompt and confirm user input, and to output any relevant messages before, during or after processing, for example, "coating now in progress", and the like messages. Also, the controller 170 may detect various conditions, such as "coating material reservoir nearly empty" and the like conditions, and appropriately inform an operator via the message output device.

The controller 170 may be implemented on a programmed general purpose computer. However, the controller 170 can also be implemented on a special purpose computer, a programmed microprocessor or microcontroller and peripheral integrated circuit elements, an integrated circuit, a digital signal processor, a hardwired electronic or logic circuit such as a discrete element circuit, a programmable logic device, or the like devices. The memory (not shown) can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory, or the like implementations. Similarly, the non-alterable or fixed memory can be implemented using any one or more of ROM, PROM, EPROM, EEPROM, an optical ROM disk, such as a CD-ROM or DVD-ROM disk, and disk drive, or the like implementations.

It will be readily appreciated by one of ordinary skill in the art upon comprehending the present invention that the a coating device 110 of coating system 100 can be, for example, conveniently replaced or substituted with the abovementioned direct writing applicator or micropen to enable the coating apparatus and processes of the present invention. It will also be readily appreciated by one of ordinary skill in the art that similar or alternative configuration of system components can be used to obtain the desire coating results of the present invention.

FIG. 2 shows an embodiment of a direct writing applicator device 125. The direct writing applicator device is attached to the coating device 110. The direct writing applicator device dispenses the coating material 310 onto the object 200 while the rotation device 140 rotates the object 200 and the linear movement device 130 moves the coating device 110 in the direction shown by the arrow A.

While this invention has been described in conjunction with the specific embodiments described above, other modifications, alternatives, and variations of the present invention may occur to one of ordinary skill in the art based upon a review of the present application and these modifications, including equivalents substantial equivalents, similar equivalents and the like thereof, are intended to be included within the scope of the present invention. Accordingly, the specific embodiments of the invention, as set forth above, are intended to be illustrative not limiting.

What is claimed is:

1. A process for coating a photoconductor, said process comprising:

providing a cylindrical substrate rotating about the long axis;

applying at least one coating layer with a direct writing applicator on the outer surface of the rotating substrate;

curing the resulting coated layer or layers; and applying a spreading and coalescing force on said coated layer or layers to provide a coating having a uniform thickness, the spreading and coalescing force consisting of a force selected from the group consisting of capillary action, surface centrifugation, vibration, ultrasonic excitation, and combinations thereof, wherein said cylindrical substrate is rotated at a rotational rate and said coating is dispensed from said direct writing applicator at a coating dispense rate such that the rotational rate of the cylindrical substrate and the coating dispense rate provide a single coating coverage rate of from about 0.1 square inches per second to about 5 square inches per second.

2. A process in accordance with claim 1, wherein the rotating is accomplished by mounting the cylindrical substrate on a rotating spindle.

3. A process in accordance with claim 1, wherein the at least one coating is a photoconductive material.

4. A process in accordance with claim 1, wherein the at least one coating is an electrically insulating material.

5. A process in accordance with claim 4, further comprising applying at least one coating of a photoconductive material over the resulting electrically insulating material layer.

6. A process in accordance with claim 5, wherein from about 2 to 10 coatings of a photoconductive material are applied over the resulting electrically insulating material layer.

7. A process in accordance with claim 5, further comprising applying at least one coating of a hole transport material over the resulting photoconductive material layer or layers.

8. A process in accordance with claim 5, further comprising applying at least one coating of a protective overcoating material over the resulting photoconductive material layer or layers.

9. A process in accordance with claim 7, further comprising applying at least one coating of a protective overcoating material over the resulting hole transport material layer.

10. A process in accordance with claim 1, wherein the at least one coating is applied to the substrate in a thickness of from about 0.0001 inches to about 0.01 inches.

11. A process in accordance with claim 1, wherein the at least one coating is applied to the substrate in a lateral width of from about 0.002 inches to about 0.2 inches.

12. A process in accordance with claim 1, wherein the coating dispense rate from the direct write applicator is continuous and provides a continuous coating layer of uniform layer thickness.

13. A process in accordance with claim 1, wherein the coating dispense rate from the direct write applicator is discontinuous and provides a discontinuous coating of uniform layer thickness.

14. A process in accordance with claim 1, wherein the at least one coating is a mixture of at least two co-reactive materials.

* * * * *